United States Patent [19]

Weeks et al.

[11] 3,946,581

[45] Mar. 30, 1976

[54] LOCKS

[76] Inventors: Wilfred Gwyn Weeks, 9 Downside, Portishead, Bristol; Malcolm Arthur Taylor, New Leaze, Olveston, Bristol, both of England

[22] Filed: Mar. 11, 1974

[21] Appl. No.: 450,066

[30] Foreign Application Priority Data

Mar. 14, 1973 United Kingdom ..... 12354/73

[52] U.S. Cl. ..... 70/6; 70/32

[51] Int. Cl.[2] ..... E05B 65/48; E05B 67/30

[58] Field of Search ..... 70/32, 33, 34, 386, 6–13, 70/23

[56] References Cited

UNITED STATES PATENTS 834,591 10/1906 Streams ..... 70/32 X 1,692,826 11/1928 Ganz ..... 70/231

*Primary Examiner*—Robert L. Wolfe

*Attorney, Agent, or Firm*—Mason, Kolehmainen, Rathburn & Wyss

[57] ABSTRACT

A lock assembly for locking one member, such as a door, to another member, such as the frame, comprises a stud unit and a lock unit which can be locked on the stud by means comprising a slide which is engaged between the stud and a surface in the lock unit, a locking ball which extends through an opening in the slide into either a recess in the stud to prevent separation of the units or a recess in the lock unit, which allows such separation, a catch for holding the slide locked and a key-operated lock for releasing the slide.

10 Claims, 7 Drawing Figures

FIG. 1
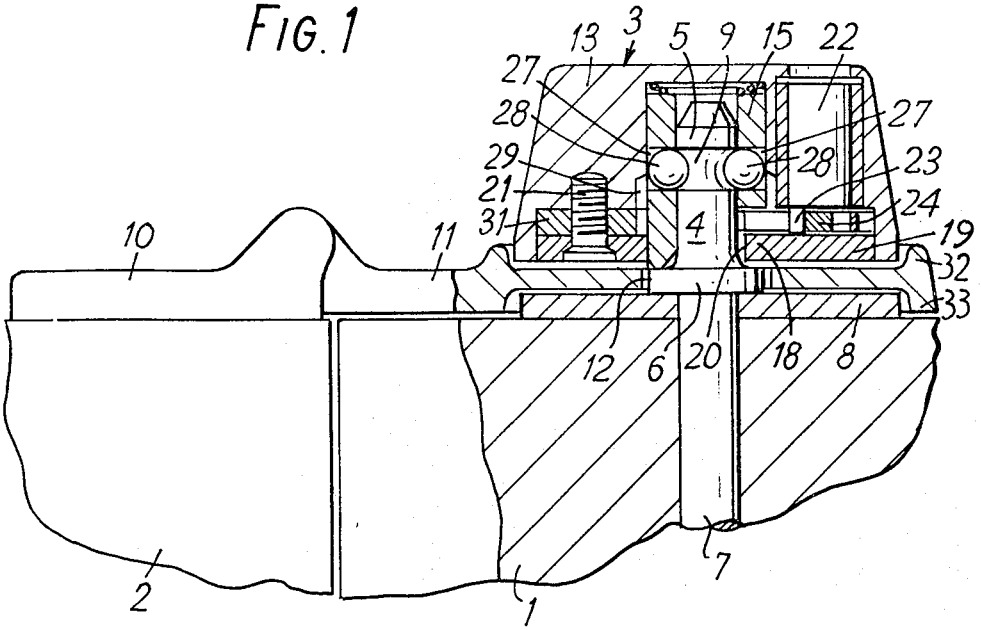
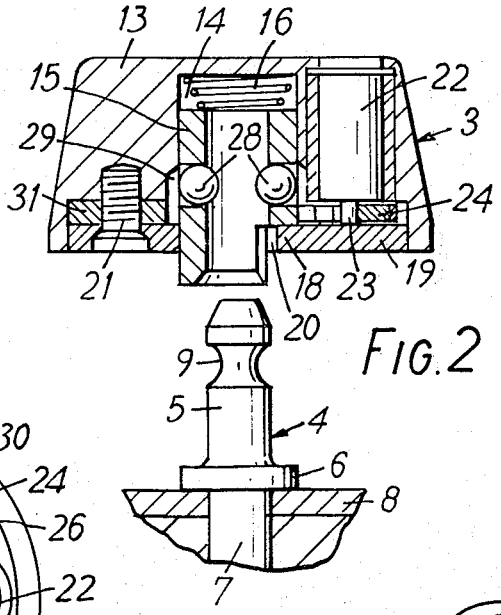
FIG. 2
FIG. 3
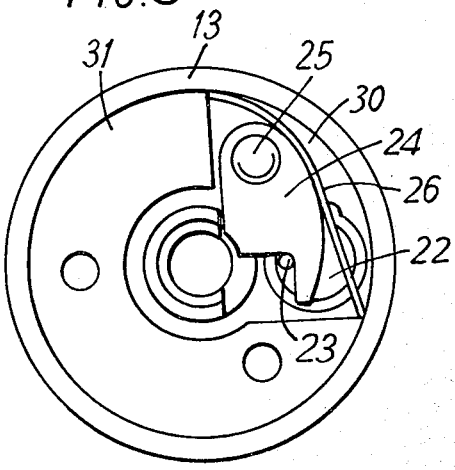
FIG. 4
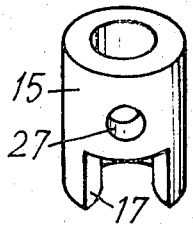

LOCKS

BACKGROUND OF THE INVENTION

Many forms of lock have been proposed for locking doors, windows and container lids or covers, to give a few examples. A common one is a padlock used for locking a hasp on one member to a staple on the other. Other locks of many kinds have also been proposed for similar or sometimes quite different purposes, but a general problem always exists when it is desired to provide a lock which is strong and difficult to force, which can be produced economically and which is convenient in use. It is one of the objects of this invention to provide a lock assembly which, whilst being convenient to use, can nevertheless be made very strong and which is very difficult for a thief to force.

According to the invention in one of its aspects a lock assembly is provided which assembly comprises two separable units having respectively a stud and a passage to receive the stud, wherein the assembly includes:

a slide which is carried by one of the units for limited sliding movement relatively thereto and which occupies a space between the stud and a side of the passage when the units are fitted together;

at least one locking element which is movable in a transverse through opening formed in the slide from a release position, in which it engages in a recess formed in one unit which allows movement of the slide and separation of the units, and a locking position in which it engages in a recess formed in the other unit;

a catch element which engages the slide when the units are fitted together and the locking element is in the second said recess so as to lock the units together; and a lock which is operable by a key to disengage the catch element from the slide and allow separation of the units.

In certain preferred constructions one of the units is in the form of a stud having an annular groove forming one of the recesses and other unit (the lock unit) comprises a circular body in which the slide, which is in the form of a cylindrical sleeve, is mounted for limited sliding movement. The walls of the slide are formed with two (or any other number of) openings in each of which a ball forming a locking element is mounted. In one position of the slide, which it occupies when the lock unit is removed from the stud unit, the balls are free to move outwardly to allow removal of the lock unit from the stud, whereas when the sleeve is in its other position, in which it is held by the locking element, the balls are held in the groove in the stud and lock the units together.

As will appear from the following description, the invention provides a particularly strong lock assembly, one of the advantages of which is that the lock unit is freely rotatable on the stud or its equivalent, when locked thereon, so the mechanism cannot be forced and broken by turning the lock unit, which can be designed to cover and protect the stud unit.

Two embodiments of the invention are shown, by way of example, in the accompanying drawings, in which:

FIG. 1 is a side view, partly in cross-section, showing one example of the invention with the lock unit in its locked position;

FIG. 2 is a cross-sectional view showing the main parts of the assembly of FIG. 1, when unlocked;

FIG. 3 is an underneath view of the lock unit of FIGS. 1 and 2 with its bottom plate removed;

FIG. 4 is a detail view of part of the assembly of FIGS. 1 to 3;

Figure 5:
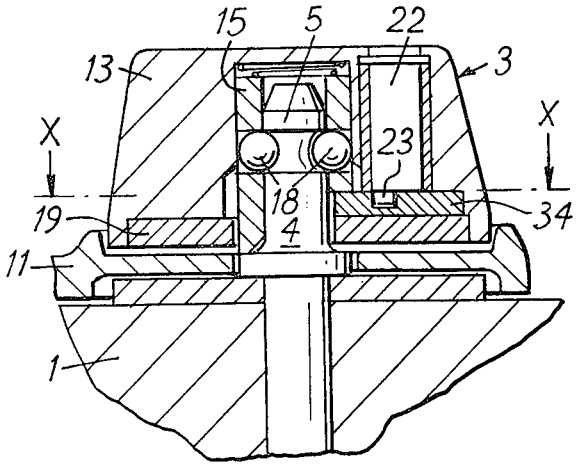
FIG. 5 is a vertical cross-section showing a modification of the lock shown in FIGS. 1 to 4.

Referring to FIG. 1, this shows two members, such as a door 1 and its frame 2, which are locked together by a lock assembly exemplifying the invention. This assembly comprises a removable lock unit 3 and a stud unit 4 comprising a stud 5 having a flange 6 and a shank 7, by which it is secured to the door 1 by a nut or other means (not shown), with a plate 8 clamped between the flange and the door. The stud 5 is formed with an annular recess 9.

Fixed to the frame 2 by suitable means, such as bolts or studs (not shown), is a base plate 10 to which a hasp 11 is hinged. This hasp is formed with an opening 12 so that when the door is to be locked the hasp 11 can be swung over the stud 5 into the position shown in FIG. 1, in which it is then locked by fitting the lock unit 3.

This unit 3 comprises a body 13 of hardened steel having a central bore 14 (FIG. 2) in which a cylindrical slide 15 operates under the action of a spring 16.

The slide 15 is formed with a cutout 17 (FIG. 4) to receive a shoulder 18, which forms part of a bottom plate 19 and projects into a central hole 20 formed in the latter. The plate 19 is secured to the body 13 by screws 21. A cylinder lock 22 is mounted in the body 13 on one side of the bore 14 and carries an operating pin 23 which engages a catch element 24 (FIG. 3). In this construction the catch element 24 has the form of a pawl which is pivoted at 25 to the body 13 and is pressed by a leaf spring 26 into the cut-out 17 when the slide 15 is in its upper locking position (as shown in FIG. 1), in which it is held by the pawl 24. By using a key in the lock 22 the pawl 24 can be moved out of the cut-out 17 to allow the slide 15 to move down and permit the release of the unit 3 from the stud 5, as is shown in FIG. 2 and will be described.

The slide 15 is formed with one or more holes 27 (two are shown) in each of which a locking element in the form of a ball 28 is mounted. The diameters of the balls are greater than the thickness of the wall of the slide 15. When the unit 3 is pressed on to the stud 5 the slide 15 engages the flange 6 and is pressed by the latter from its release position (FIG. 2) to its locking position (FIG. 1). When in the release position the balls 28 are free to move outwardly in the slide 15 into an annular recess or bore section 29 of larger diameter in the body 13, thus allowing the lock unit 3 to be fitted to or removed from the stud 5, whereas when the slide 15 is in the position shown in FIG. 1 the balls 28 are forced into the recess 9 in the stud 5. It is the action of fitting the lock unit to the stud which forces the slide 15 and balls 28 upwardly in this way and once this has been done the catch pawl 24 is forced by its spring 26 into the cut-out 17 in the stud 15. The result of this is to lock the unit 3 positively on the stud 5 and the mechanism is self-locking without the use of a key. The lock unit 3 can only be unlocked to allow removal from the stud 4 by using a key in the lock 22 to retract the pawl 24 from the cut-out 17. The lock unit 3 can then be lifted from the stud 5, the hasp 11 swung back and the door opened. The balls 28 are prevented from the dropping into the interior of the slide 15 by the fact that when drilling the holes 27 the drill is stopped before it has completely passed through the wall of the slide so as to leave the holes 27 with inner lips.

For practical reasons the recess 30 (FIG. 3) needed for the pawl mechanism, instead of being cut from the body 13, is formed by interposing a plate 31 of the shape shown in FIG. 3 between the body and the plate 19.

The lock assembly which has been described offers a number of advantages. The stud unit 4 and also the hasp 11 and its base 10 can be made very strong (of hardened steel), and can be fixed to the door and its frame very securely, with the stud 4 completely protected when the assembly is locked. This protection is helped by upper and lower rims 32 and 33 formed integrally with the hasp 11 so that they surround the plate 8 and the lower edge of the unit 3 as shown in FIG. 1 and prevent the insertion of a tool under the unit 3, it being noted that the body 13 is circular and concentric with its axis of rotation.

A further and very important advantage is that the lock unit 3, when it has been locked on the stud 5, is still free to rotate so that it is no help to a would-be thief to be able to turn it using a wrench or similar tool. The sides of the body 13 can be tapered as shown to make it more difficult to force.

The locking effected by the slide 15, balls 28 and the pawl 24, which is strongly held by the protected bottom plate 18, is very positive.

Although it has not been shown a deadlock could be provided in the form of a small locking pin mounted in the body 13 so that it is urged by a spring into engagement with a recess or slot formed in the pawl 24, the arrangement being such that this pin engages the pawl when the latter is in its inner locking position, in which it is positively held by the pin. This pin can only be withdrawn to allow movement of the pawl by the operation of the lock 22, which can then retract the pawl. With this arrangement even the drilling out of the cylinder lock 22 would not allow the pawl 24 to be moved to release the slide 15 unless the deadlock pin is also drilled out.

Figure 6:
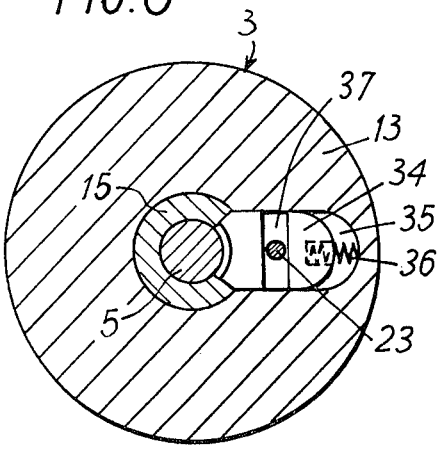
FIG. 6 is a cross-section taken on the line X—X of FIG. 5.
Figure 7:
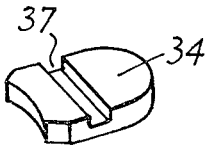
FIG. 7 is a detail view of part of the lock of FIGS. 5 and 6.

FIGS. 5 to 7 show a lock assembly which is very similar to the one which has been described and the same reference numerals are used for similar parts. The main differences between the two constructions is the replacement of the pawl 24 by a tongue 34. This tongue is slidable in a recess 35 in the body 13 and is pressed inwardly to engage in the cut-out 17 in the slide 15 by a spring 36. The pin 23 of the cylinder lock 22 engages a slot 37 in the tongue 34 to operate the latter. A deadlock pin engaging in the slide 34 may also be provided in this construction.

Although the use of a slide in the form of a cylinder mounted within the body of the removable lock part of the assembly, so that only a simple stud has to be mounted on the door or equivalent member, offers many advantages, a number of modifications would be possible. For example, the slide and balls or other locking elements could be mounted and remain permanently on the stud 4 when the lock unit 3 is removed. Also, instead of a cylindrical slide other forms might be possible. Thus the cylinder could be replaced by a simple sliding plate carrying a ball or other locking element, this plate being carried either on the fixed part of the lock, which need not be a stud of circular section, or else in the other part of the lock (the lock unit).

According to another modification, the stud could be mounted within the removable part of the lock and arranged to engage in a tubular element mounted on the door in place of the stud, the slide and balls or other locking elements being in the removable part.

We claim:

1. A lock assembly comprising two separable units having respectively a stud and a bore to receive the stud, which assembly comprises:

a slide which is carried by one of said units for limited sliding movement relatively thereto and which occupies a space between said stud and a side of said bore when said units are fitted together:

at least one locking element which is movable in a transverse through opening formed in said slide from a release position, in which said locking element engages in a recess formed in one of said units which allows movement of said slide and separation of said units, and a locking position in which said locking element engages in a recess formed in the other of said units;

a catch element which engages said slide when said units are fitted together and the locking element is in the second said recess so as to lock said units together;

a lock which is operable by a key to disengage said catch element from the said slide and allow separation of said units:

one of said units comprising said stud and means for fixing said one unit to one of two members to be locked together, the other of said units comprising a body in which said passage is formed, and including said slide, at least one ball forming said locking element, said catch element and said key-operated lock; and said catch element comprising a pawl which is pivoted to said body, a bottom plate secured to the under side of said body for limiting the movement of said slide out of said body.

2. A lock assembly according to claim 1, wherein said slide is in the form of a cylinder which is slidable in the said passage and receives said stud when said units are fitted together.

3. A lock assembly according to claim 1, wherein the second said recess surrounds said stud so as to allow the other of said units to turn freely on said stud when the units are locked together.

4. A lock assembly according to claim 1, wherein said locking element is in the form of a ball of a diameter greater than the length of the said opening in said slide accommodating it, so that when the units are being fitted together or are being separated, with movement of said slide, the said locking element is transferred from one of said recesses to the other.

5. A lock assembly according to claim 1, wherein the said lock is a cylinder lock mounted in said body.

6. A lock assembly comprising two separable units having respectively a stud and a bore to receive the stud, which assembly comprises:

a slide which is carried by one of said units for limited sliding movement relatively thereto and which occupies a space between said stud and a side of said bore when said units are fitted together;

at least one locking element which is movable in a transverse through opening formed in said slide from a release position, in which said locking element engages in a recess formed in one of said units which allows movement of said slide and separation of said units, and a locking position in which said locking element engages in a recess formed in the other of said units;

a catch element which engages said slide when said units are fitted together and the locking element is in the second said recess so as to lock said units together;

a lock which is operable by a key to disengage said catch element from the said slide and allow separation of said units;

one of said units comprising said stud and means for fixing said one unit to one of two members to be locked together, the other of said units comprising a body in which said passage is formed, and including said slide, at least one ball forming said locking element, said catch element and said key-operated lock; and said catch element including a catch mounted for sliding movement in a space below said body, and a bottom plate secured to the under side of said body, which plate holds said catch and limits the movement of said slide out of said body.

7. A lock assembly according to claim 1, wherein the said stud and the said unit with the said passage are both of substantially circular cross-sections concentric with the axis of said passage when the units are fitted together.

8. A lock assembly according to claim 7, which also includes a hasp pivoted to a plate which is adapted to be secured to one of two members to be locked together, the unit with said stud being adapted to be secured to the other of said members, wherein the said hasp is formed with a hole adapted to receive said stud and with a raised rim which surrounds the other of said units when said units are locked together to provide protection against the insertion of a tool to force said units apart.

9. A lock assembly according to claim 1, which also includes a dead-lock member and means biasing said member into a position in which it prevents said catch member from being disengaged from said slide, from which position said dead-lock member can be withdrawn by unlocking action of said key-operated lock.

10. A lock assembly comprising two separable units having respectively a stud and a passage to receive said stud, one of said units being adapted to be secured to one of two members to be locked together and the other of said units being removable from the first said unit, wherein the assembly comprises:

a cylindrical slide which is carried by one of said units for limited sliding movement relatively thereto and which occupies a space between said stud and a side of said bore when said units are fitted together;

at least one locking element in the form of a ball which is movable in an opening formed through the wall of said slide from a release position, in which said locking element engages in a recess formed in one of said units which allows movement of said slide and separation of the units, and a locking position in which said locking element engages in a recess formed in the other of said unit, the diameter of said ball being greater than the length of said opening:

a catch element which engages said slide when the said units are fitted together and said locking element is in the second said recess so as to lock the units together; and a lock which is operable by a key to disengage said catch element from said slide and allow movement of said slide and locking elements and separation of said units;

said stud forming an integral part of the first said unit and including a projecting flange and an annular groove around it forming the second said recess, and the other said unit comprises a substantially circular body which contains said slide, locking element, catch element and lock, said passage and first said recess being formed in said body, a bottom plate formed with an opening for the passage of said stud and of part of said slide for engagement of the slide with said flange when said units are fitted together, and a spring biasing said slide against said bottom plate.

* * * * *